US008336156B1

(12) United States Patent
Shimazu

(10) Patent No.: US 8,336,156 B1
(45) Date of Patent: Dec. 25, 2012

(54) BABY BOTTLE MICROFIBER DRYING WAND

(76) Inventor: Nicole Shimazu, Kalaheo, HI (US)

( * ) Notice: Subject to any disclaimer, the term of this patent is extended or adjusted under 35 U.S.C. 154(b) by 655 days.

(21) Appl. No.: 12/460,383

(22) Filed: Jul. 17, 2009

Related U.S. Application Data

(60) Provisional application No. 61/135,082, filed on Jul. 17, 2008.

(51) Int. Cl.
*A47L 17/00* (2006.01)

(52) U.S. Cl. ..... 15/211; 15/164; 15/223; 15/226

(58) Field of Classification Search ..... 15/164, 15/176.1, 211, 223, 226
See application file for complete search history.

(56) References Cited

U.S. PATENT DOCUMENTS

| | | | | |
|---|---|---|---|---|
| 488,784 | A | 12/1892 | Zolper | |
| D335,223 | S | 5/1993 | Shumway et al. | |
| 5,488,747 | A | 2/1996 | Woodhouse | |
| 5,608,938 | A | 3/1997 | Baschenis | |
| 5,621,941 | A | 4/1997 | Liu | |
| 6,182,322 | B1 * | 2/2001 | Tubman | 15/172 |
| 6,349,443 | B1 | 2/2002 | Randolph et al. | |
| 6,532,619 | B2 | 3/2003 | Kasper et al. | |
| D509,660 | S | 9/2005 | Listenberger et al. | |
| 2004/0148721 | A1 * | 8/2004 | Spaulding | 15/118 |
| 2007/0119011 | A1 * | 5/2007 | Ho et al. | 15/172 |

FOREIGN PATENT DOCUMENTS

| | | | |
|---|---|---|---|
| EP | 326363 | * | 8/1989 |

* cited by examiner

*Primary Examiner* — Mark Spisich
(74) *Attorney, Agent, or Firm* — Montgomery Patent & Design LLC; Robert C. Montgomery; Joseph Yaksich

(57) ABSTRACT

A device to aid in drying baby bottles after washing is herein disclosed, comprising a plastic handle, a flexible "wand", and a drying head having a plurality of absorbent cloth strips. In use, the cloth end of the device is reciprocated therewithin a baby bottle after it has been washed and rinsed. The cloth strips and drying head are removably attached thereto the handle assembly and may be released for washing, drying, or and/or replacement purposes. In such a manner the highly absorbent cloth strips will absorb any excess moisture in a bottle, thereby leaving the bottle clean and dry.

13 Claims, 4 Drawing Sheets

BABY BOTTLE MICROFIBER DRYING WAND

RELATED APPLICATIONS

The present invention was first described in and claims the benefit of U.S. Provisional Application No. 61/135,082, filed Jul. 17, 2008, the entire disclosures of which are incorporated herein by reference.

FIELD OF THE INVENTION

The present invention relates generally to drying devices for container, and more particularly, to a drying wand having a microfiber drying head designed for drying the inside of baby bottles.

BACKGROUND OF THE INVENTION

Caring for a newborn baby can be one of the most rewarding times in a person's life; it is also often one of the most taxing. When a new baby comes into the home, a whole new set of daily tasks comes with them. One (1) task that occupies much of a parent's time is the process of cleaning baby bottles after use. While the actual cleaning process is fairly straight forward, drying the bottles afterwards can cause many problems. If the bottles are placed upside down on a counter, the opening can become contaminated and this position traps moisture inside of the bottle making it more difficult to dry properly. Should the bottle be placed upright, excess rinse water will pool in the bottom causing extended drying time. Many parents resort to simply stuffing a kitchen towel inside with the aid of a long handled utensil, such as a spoon. Unfortunately, this process takes time and is often difficult due to the bulk of the towel compared to the bottle opening. Additionally, towels are commonly used for other tasks around the kitchen that may contaminate them with germs and bacteria which are then transferred to the interior of the bottle.

Various solutions have attempted to provide brushes and cleaning devices intended to clean the inside of baby bottles. These solutions typically utilize an elongated flexible rod or stem with a handle on a first end and a brush or bristled area on a second end. These devices are intended to make contact with the inside walls, base, and opening of the baby bottle. Some solutions additionally provide a motor assembly to provide a rotational cleaning motion to the brush head or bristle portion of the device. Other attempts provide brush heads with specially designed shapes for improved contact with interior walls or lower base surfaces. Typically the brush head or bristle portion are made of a stiff material to provide sufficient rigidity to adequately clean and scrub the interior of the bottles.

Examples of these attempts can be seen by reference to several U.S. Patents, including: U.S. Pat. No. 5,488,747, issued in the name of Woodhouse, which describes a brush for cleaning bottles; U.S. Pat. No. 5,608,938, issued in the name of Baschenis, which describes a bottle brush assembly; and U.S. Pat. No. 5,621,941, issued in the name of Liu, which describes a baby bottle cleaning device including dual brushes.

Additionally, ornamental designs for bottle brushes exist, particularly, U.S. Pat. Nos. D 335,223 and D 509,660. However, none of these designs are similar to the present invention.

While these devices fulfill their respective, particular objectives, the referenced devices do not address the need to properly dry a washed baby bottle. Accordingly, there exists a need for a means by which baby bottles can be dried after washing without the disadvantages as described above. The development of the present invention substantially departs from the conventional solutions and in doing so fulfills this need.

SUMMARY OF THE INVENTION

In view of the foregoing references, the inventor recognized the lack a solution to the aforementioned inherent problems and observed that there is a need for a means to simply and effectively dry the interior surfaces of a baby bottle and thus, the object of the present invention is to solve the aforementioned disadvantages and provide for this need.

To achieve the above objectives, it is an object of the present invention to provide a baby bottle microfiber drying wand that provides a means for drying bottles with deep inner cavities, such as baby bottles. The drying wand provides a means to quickly and efficiently remove all moisture from the interior surfaces of a baby bottle.

Another object of the drying wand is to provide a device generally comprising a drying head assembly having a plurality of drying strips mounted radially around a central pOst which is placed inside a baby bottle following a normal washing and rinsing process. The drying strips absorb any residual moisture remaining within the bottle after washing. The device comprises a handle assembly and the removable drying head.

Yet still another object of the drying wand is to provide a device generally comprising a handle assembly having a grip and a stem portion. The grip has an ergonomic cylindrical plastic shape which is covered with a high-friction coating. The stem portion is made of a flexible or semi-rigid material that provides angular flexibility between the drying head assembly and the handle assembly during use.

Yet still another object of the drying wand is to provide a device having a removably attached and replaceable drying head assembly. The stem portion comprises an integral connecting portion which enables removable insertion into a receiver portion of the drying head assembly.

Yet still another object of the drying wand is to provide a device having the connection portion with a stabilizing disc and a male locking feature which communicate with an internal female locking feature of the receiving portion of the drying head assembly.

Yet still another object of the drying wand is to provide a device having draying head assemblies of varying diameters and lengths and stem portions of varying lengths to accommodate the drying of baby bottles having various sizes.

Yet still another object of the drying wand is to provide a method of utilizing the device that assures a parent or care giver that baby bottles are dried in a manner which is quick, easy, effective, and sanitary.

Yet still another object of the drying wand is to provide a method of utilizing the device generally comprising the steps of installing a new or dried drying head assembly onto the handle assembly and inserting the drying head assembly into the bottle opening and moving the drying head assembly in circular and up-and-down patterns inside a bottle cavity, thereby absorbing any excess moisture inside the bottle and obtaining the additional benefit from convenient, effective, and sanitary drying of bottles.

Yet still another object of the drying wand is to provide a method of replacing the drying head generally comprising the steps of detaching the drying head assembly from the handle assembly by manually disengaging the respective male locking and female locking features and drying, washing and drying, or discarding the drying head and attaching a cleaned, dried, or new drying head assembly onto the handle assembly.

Further objects and advantages of the drying wand will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
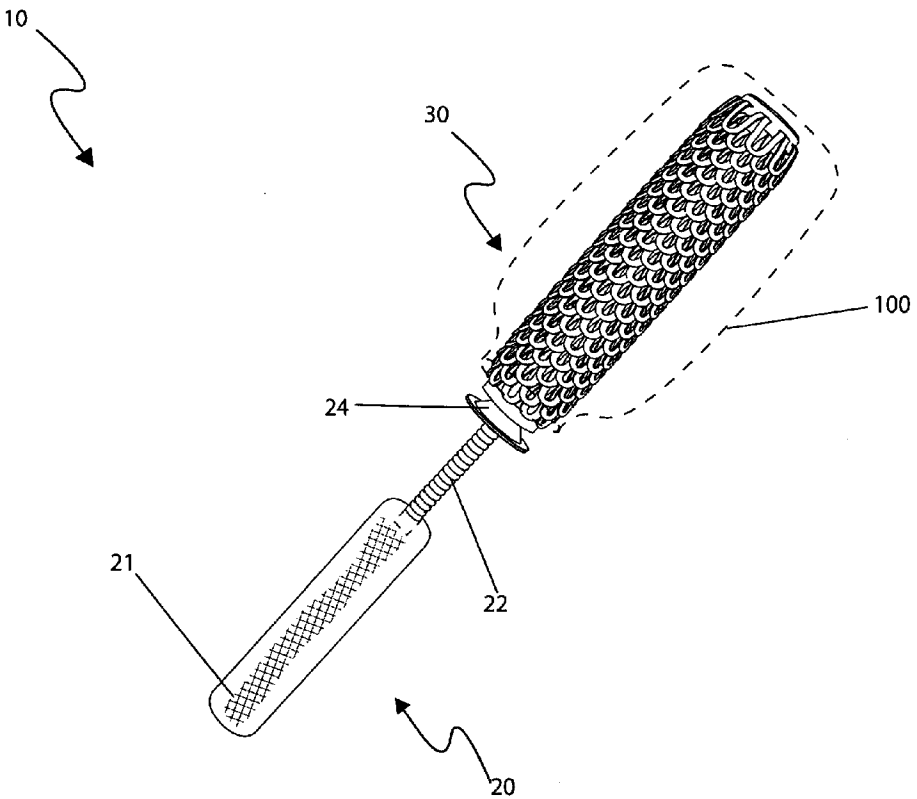
FIG. 1 is a side view of a baby bottle microfiber drying wand 10, according to a preferred embodiment of the present invention.

| | |
|---|---|
| 10 | baby bottle microfiber drying wand |
| 20 | handle assembly |
| 21 | grip |
| 22 | stem portion |
| 23 | connection portion |
| 24 | stabilizing disc |
| 26 | male locking feature |
| 30 | drying head assembly |
| 32 | center post |
| 34 | drying strip |
| 36 | aperture |
| 38 | securing means |
| 40 | receiver portion |
| 42 | female locking feature |
| 100 | bottle |

DETAILED DESCRIPTION OF THE PREFERRED EMBODIMENT

The best mode for carrying out the invention is presented in terms of its preferred embodiment, herein depicted within FIGS. 1 through 4. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a baby bottle microfiber drying wand (herein described as the "device") 10, which provides a means for aiding in drying bottles 100 having deep inner cavities, such as baby bottles. After washing, the device 10 utilizes a plurality of drying strips 34 connected to a drying head assembly 30 to absorb residual moisture remaining therewithin a bottle 100. The device 10 comprises a handle assembly 20 and the removable drying head 30 which is placed inside the bottle 100 following normal washing and rinsing, thereby absorbing any excess moisture within the bottle 100 via the highly absorbent drying strips 34. The device 10 provides improved convenience and a more sanitary method of drying said bottles 100.

Referring now to FIG. 1, a side view of the device 10, according to the preferred embodiment of the present invention, is disclosed. The device 10 comprises a handle assembly 20 further comprising grip 21 and stem 22 portions. The grip 21 comprises an ergonomic cylindrical plastic shape and is covered therewith a high-friction coating of rubber or similar material. The grip 21 is to be held securely therewithin a hand of a user in an expected manner. The grip 21 is preferably made of a plastic material and fabricated using common injection molding processes.

The grip 21 provides an attachment means thereto the stem portion 22 being insertingly molded thereinto an upper end portion of said grip 21. The stem portion 22 comprises a chrome plated or stainless steel coiled spring construction being approximately one-quarter (¼) inch in diameter, thereby providing angular flexibility therebetween the aforementioned drying head assembly 30 and said handle assembly 20 during use. However, it is further envisioned that the stem portion 22 may also be made using other flexible or rigid plastic materials while providing equal benefit thereto a user and as such should not be viewed as a limitation of the device 10. The stem portion 22 is envisioned to be easily washed and dishwasher safe, thereby staying free of contaminates and other sanitary concerns.

The device 10 also comprises a drying head assembly 30 comprising a plurality of microfiber cloth strips 34 being attached thereto a central post portion 32 of the drying head 30 and dispersing radially around said drying head assembly 30, however, said device 10 may be introduced with a variety of other natural or synthetic materials providing equally absorbent qualities. The drying head assembly 30 is envisioned to be removably attachable thereto the stem portion 22 via a connection portion 23, thereby allowing a user to clean or replace said drying head assembly 30 (see FIG. 2). The device 10 is envisioned to be approximately ten (10) inches in length in order to accommodate the depth of a standard baby bottle 100, although the device 10 may be introduced in a variety of lengths based upon different size bottles 100 as well as a user's preference and as such should not be viewed as a limiting factor of the device 10.

Figure 2:
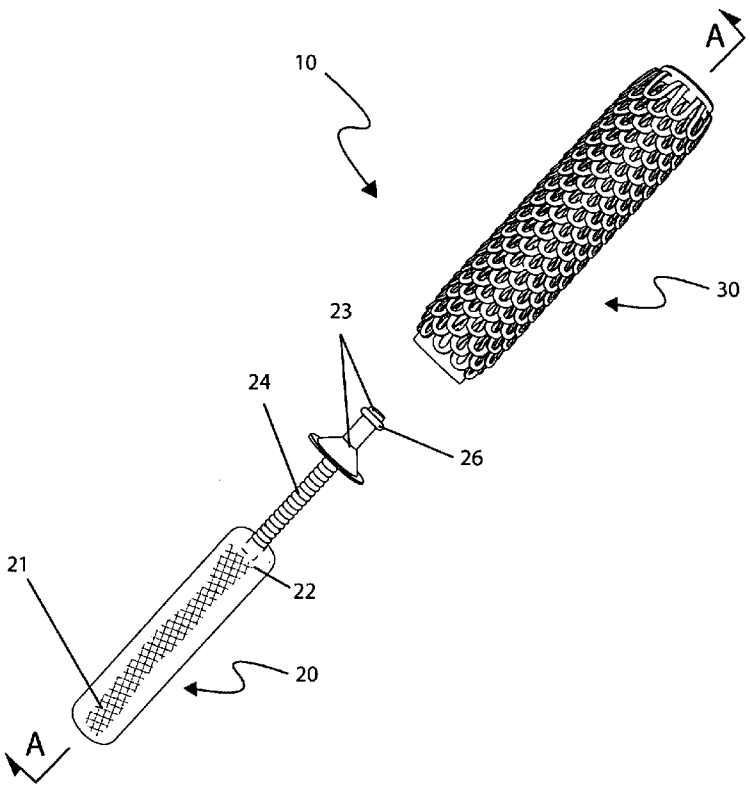
FIG. 2 is a side view of the baby bottle microfiber drying wand 10 depicting separation of a drying head assembly 30 therefrom the handle assembly 20, according to a preferred embodiment of the present invention.

Referring now to FIG. 2, a side view of the device 10 depicting separation of a drying head assembly 30 therefrom the handle assembly 20, according to the preferred embodiment of the present invention, is disclosed. The stem portion 22 comprises an integral connecting portion 23 which in-turn provides removable attachment of the drying head assembly 30 thereto. Said connecting portion 23 preferably made of a plastic material being affixed thereto said handle assembly 20 via an injection-molded attachment thereto an upper end portion of said stem portion 22. The connection portion 23 further comprises a stabilizing disc 24 and a male locking feature 26 which work in conjunction therewith an internal female locking feature portion 42 of the drying head assembly 30 (see FIG. 3). The stabilizing disc 24 comprises a conical flanged feature protruding orbitally therefrom said connecting portion 23, thereby acting as a mechanical stopping means and also stabilizing the drying head assembly 30 thereupon the connecting portion 23 when installed.

It is understood that the connection therebetween said stem portion 22 and the drying head assembly 30 may be accomplished using other removably attachable mechanisms such as, but not limited to; spring-loaded buttons, threaded fasteners, interference snapping, or the like, which provide equal benefit thereto a user and as such should not be interpreted as a limiting factor of the device 10.

Figure 3:
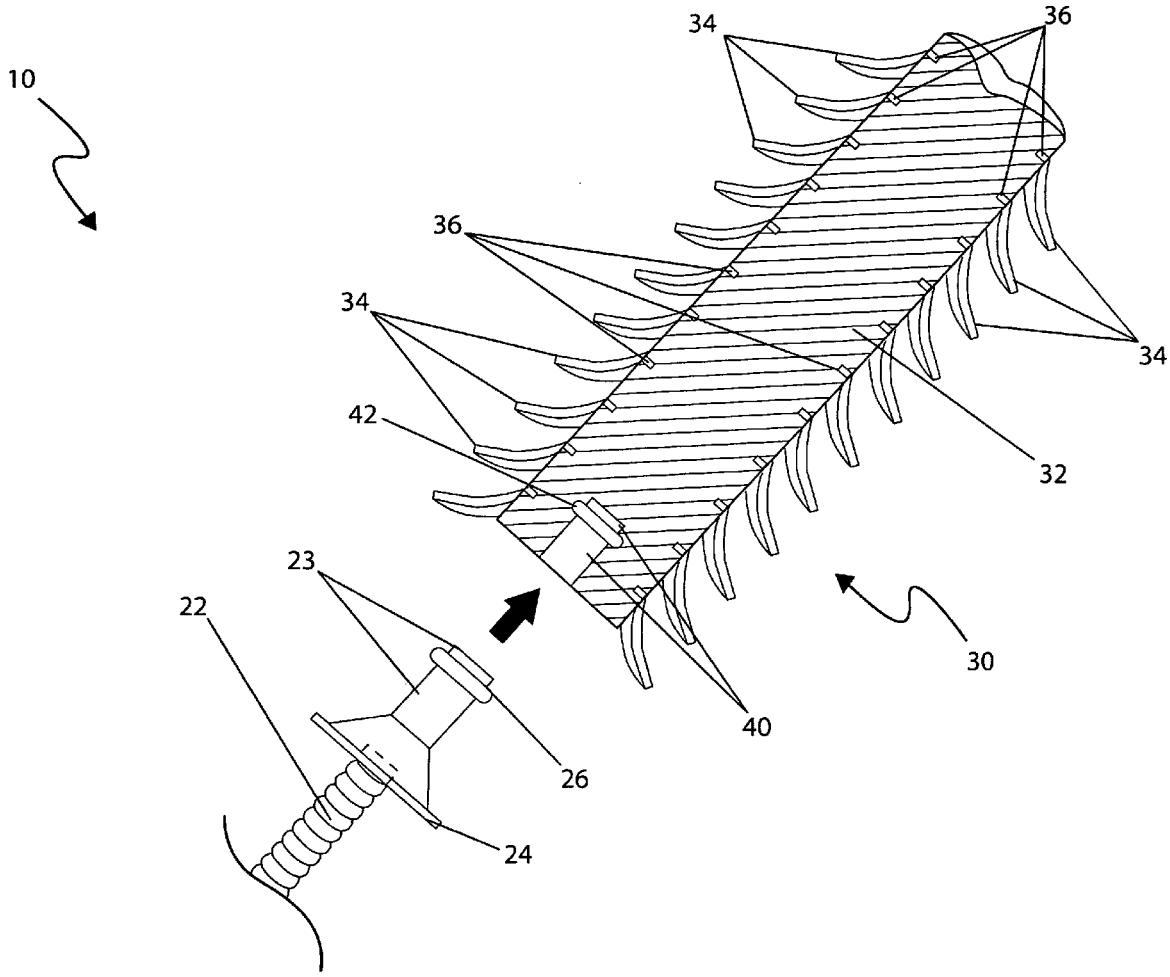
FIG. 3 is a section view of the baby bottle microfiber drying wand 10 taken along section line A-A (see FIG. 2), according to a preferred embodiment of the present invention; and, FIG. 4 is a close-up view of a drying strip portion 34 of the drying head assembly 30, according to a preferred embodiment of the present invention.

Referring now to FIG. 3, a section view of the device 10 taken along section line A-A (see FIG. 2), according to a preferred embodiment of the present invention, is disclosed. The drying head assembly 30 further comprises a center post 32, a plurality of drying strips 34, and a receiver portion 40. The center post 32 comprises a cylindrical plastic rod approximately four (4) to eight (8) inches long which provides a snapping attachment means thereto the aforementioned connection portion 23 via the receiver portion 40. The receiver portion 40 comprises an orifice which extends thereinto a bottom portion of the center post 32 being centered therealong a long axis thereof and sized so as to slidingly receive said connecting portion 23 thereinto. During installation of the drying head assembly 30, said connecting portion 23 is slidingly inserted thereinto the receiver portion 40. The receiver portion 40 further comprises an internal annular female locking feature 42 which corresponds geometrically thereto the aforementioned male locking feature 26, thereby forming a secure interference fit thereto. It is also understood that said attachment means therebetween the handle assembly 20 and the drying head assembly 30 may comprise other attachment means such as mating threaded portions or the like without deviating therefrom the concept and as such should not be viewed as a limitation of the device 10.

The drying head assembly 30 further comprises a plurality of absorbent drying strips 34 arranged therealong an entire outer surface thereof, thereby forming a dense multi-layered absorbent cylinder. The drying strips 34 comprise looped strips of an absorbent microfiber material or other highly absorbent natural or synthetic textile material, capable of quickly removing residual moisture therefrom within the bottle 100 (see FIG. 4).

After normal use of the device 10 to remove moisture therefrom one (1) or more bottles 100, the drying head assembly 30 may be manually removed therefrom the handle assembly 20 and may be dried, machine washed, or may be replaced if worn or soiled.

Figure 4:
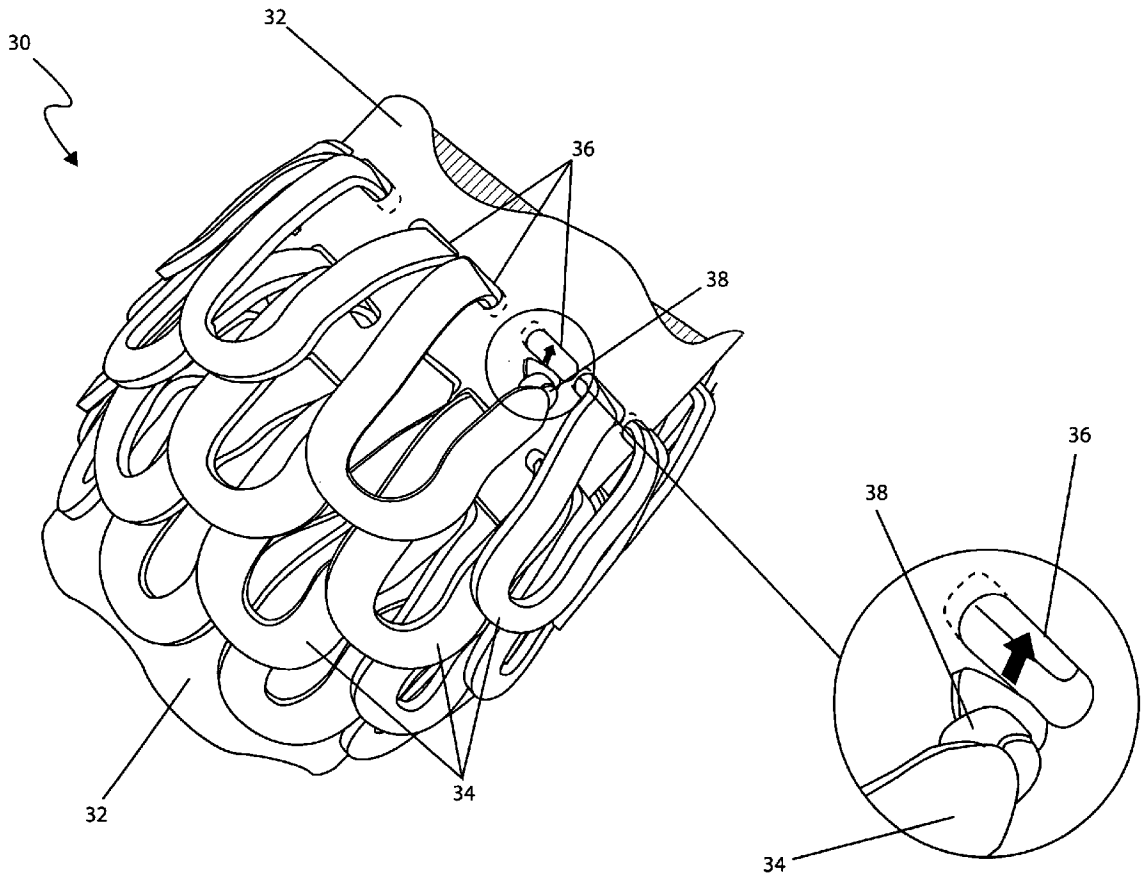

Referring now to FIG. 4, a close-up view of a drying strip portion 34 of the drying head assembly 30, according to a preferred embodiment of the present invention, is disclosed. The center post 32 provides an attachment means thereto a plurality of drying strips 34 preferably utilizing a plurality of apertures 36 arranged in parallel radial rows therearound said center post 32. Each drying strip 34 is preferably formed thereinto a loop shape having end portions with a securing means 38, preferably tied in a knot, and subsequently press-fitted thereinto two (2) adjacent apertures 36, thereby securing said drying strip 34 thereto. It is further envisioned that said drying strips 34 may be further secured therewithin said apertures 36 using a common adhesive. It is also understood that a variety of securing means 38 may be utilized to affix said drying strips 34 thereto the center post 32 such as, but not limited to: adhesive bonding, compression rings, staples, or the like and as such should not be interpreted as a limiting factor of the device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 and 2.

The method of utilizing the device 10 may be achieved by performing the following steps: installing a new or dried drying head assembly 30 thereonto the handle assembly 20 by inserting the connecting portion 23 of the handle assembly 20 thereinto the receiver portion 40 of the drying head assembly 30; continuing to press said drying head assembly 30 downwardly until engaging the male 26 and female 42 locking features; holding a washed and rinsed bottle 100 such as a baby bottle in one (1) hand; grasping and holding the grip portion 21 of the handle assembly 20 in another hand; inserting the drying head assembly 30 thereinto the bottle 100 opening; moving the drying head assembly 30 therein circular and up-and-down patterns thereinside a cavity of the bottle 100; absorbing any excess moisture inside the bottle 100 thereinto the drying strip portions 34 of the drying head 30; removing the drying head 30 from the bottle 100; repeating the drying process described above as needed; and, benefiting from convenient, effective, and sanitary drying of bottles 100 using the present invention 10.

The method of maintaining and replacing the drying head assembly 30 may be achieved by performing the following steps: detaching the drying head assembly 30 therefrom the handle assembly 20 by manually disengaging respective male locking 26 and female locking 42 features; drying, or washing and drying the drying head assembly 30 either by hand or in a dishwasher; discarding the drying head assembly 30 if replacement is required due to damage or excessive soiling; attaching a cleaned and dried drying head assembly 30 or a new drying head assembly 30 thereonto the handle assembly 20 as previously described.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A drying wand, comprising:

a handle assembly, further comprising a distal end and a proximal end;

a stem portion, comprising an elongated coiled spring and extending from said distal end to said proximal end; and, a grip attached to said stem portion and located at said distal end; and, a head assembly removably attachable to said proximal end of said handle assembly with a handle attachment means;

wherein said stem portion provides an angular flexibility means between said handle assembly and said head assembly;

wherein said handle attachment means further comprises a male locking ring circumferentially disposed about an outer surface of said proximal end of said handle assembly interconnecting with a female locking feature circumferentially disposed about an inner portion of a receiver portion of said head assembly;

wherein said receiver portion slidingly receives said proximal end of said handle assembly until said male locking ring engages said female locking feature;

wherein said handle attachment means further comprises a stabilizing disc comprising a conical flanged feature protruding orbitally from said male locking ring;

wherein said stabilizing disc provides a mechanical stopping means for said head assembly when attached via said handle attachment means;

wherein said stabilizing disc provides a stabilizing means for said head assembly when attached via said handle attachment means;

wherein said drying wand provides a drying means for inner surfaces of a container having a deep inner cavity; and, wherein said drying wand comprises a sanitary material of construction enabling cleaning of said drying wand.

2. The drying wand of claim 1, wherein said stem portion further comprises a resilient and flexible material of construction of one of the following list: chrome-plated steel, stainless steel, or plastic.

3. The drying wand of claim 1, wherein said grip further comprises an ergonomic cylindrical body covered with a high-friction coating.

4. The drying wand of claim 1, wherein said stem portion is insertingly molded in said grip.

5. The drying wand of claim 1, wherein said head assembly further comprises:

a center post, comprising an elongated cylindrical body;

said receiver portion comprising an orifice extending into a central axis of a bottom portion of said center post; and, a plurality of absorbent drying strips affixed to and arranged in a dense multi-layered arrangement about an outer surface of said center post each with a strip attachment means.

6. The drying wand of claim 5, wherein said strip attachment means further comprises:

a strip loop formed of each of said plurality of absorbent drying strips, comprising an end portion with a securing means and a front portion comprising said strip loop; and, a plurality of apertures arranged in parallel radial rows around said outer surface of said center post;

wherein said securing means of each of said plurality of absorbent drying strips is fittingly inserted into each of said plurality of apertures, such that said strip loop of each of said plurality of absorbent drying strips is extended outwardly; and, wherein said securing means securely affixes each of said absorbent drying strips to said center post.

7. The drying wand of claim 6, wherein said plurality of absorbent drying strips each comprise an absorbent microfiber material capable of quickly removing residual moisture from within said inner surfaces of said container.

8. A drying wand, comprising:

a handle assembly, further comprising:

a grip located at a distal end of said handle assembly; and, a stem portion, comprising an elongated coiled spring and extending from said distal end to a proximal end and attached to said grip; and, a head assembly, further comprising:

a center post, comprising an elongated cylindrical body;

a receiver portion, comprising an orifice extending into a central axis of a bottom portion of said center post; and, a plurality of absorbent drying strips affixed to and arranged in a dense multi-layered arrangement about an outer surface of said center post each with a strip attachment means; and, a handle attachment means for removably attaching said head assembly to said handle assembly, further comprising:

a male locking ring circumferentially disposed about an outer surface of said proximal end of said handle assembly; and, a female locking feature circumferentially disposed about an inner portion of said receiver portion of said head assembly and interconnecting with said male locking ring;

wherein said handle attachment means further comprises a stabilizing disc comprising a conical flanged feature protruding orbitally from said male locking ring;

wherein said stabilizing disc provides a mechanical stopping means and a stabilizing means for said head assembly when attached via said handle attachment means;

wherein said stem portion provides an angular flexibility means between said handle assembly and said head assembly;

wherein said receiver portion slidingly receives said proximal end of said handle assembly until said male locking ring engages said female locking feature;

wherein said drying wand provides a drying means for inner surfaces of a container having a deep inner cavity; and, wherein said drying wand comprises a sanitary material of construction enabling cleaning of said drying wand.

9. The drying wand of claim 8, wherein said stem portion further comprises a resilient and flexible material of construction of one of the following list: chrome-plated steel, stainless steel, or plastic.

10. The drying wand of claim 8, wherein said grip further comprises an ergonomic cylindrical body covered with a high-friction coating.

11. The drying wand of claim 8, wherein said stem portion is insertingly molded in said grip.

12. The drying wand of claim 8, wherein said strip attachment means further comprises:

a strip loop formed of each of said plurality of absorbent drying strips, comprising an end portion with a securing means and a front portion comprising said strip loop; and, a plurality of apertures arranged in parallel radial rows around said outer surface of said center post;

wherein said securing means of each of said plurality of absorbent drying strips is fittingly inserted into each of said plurality of apertures, such that said strip loop of each of said plurality of absorbent drying strips is extended outwardly; and, wherein said securing means securely affixes each of said absorbent drying strips to said center post.

13. The drying wand of claim 12, wherein said plurality of absorbent drying strips each comprise an absorbent microfiber material capable of quickly removing residual moisture from within said inner surfaces of said container.

* * * * *